United States Patent [19]

Hardin

[11] Patent Number: 4,918,791

[45] Date of Patent: Apr. 24, 1990

[54] CLOTHING BUTTON GUARD

[76] Inventor: James A. Hardin, 317 Broadway, South Haven, Mich. 49090

[21] Appl. No.: 318,837

[22] Filed: Mar. 6, 1989

[51] Int. Cl.[5] ..... A44B 1/16

[52] U.S. Cl. ..... 24/90.5; 24/113 MP

[58] Field of Search ..... 24/90.5, 113 MP, 113 R

[56] References Cited

U.S. PATENT DOCUMENTS

| | | | |
|---|---|---|---|
| 138,745 | 5/1873 | Freeman | 24/90.5 |
| 581,111 | 4/1897 | Goodwin | 24/113 MP |
| 995,866 | 6/1911 | Happich et al. | 24/90.5 |
| 1,180,104 | 4/1916 | Barnes | 24/113 MP |
| 3,757,388 | 9/1973 | Wolny | 24/113 MP |
| 3,777,336 | 12/1973 | Anderson | 24/113 MP |
| 3,934,313 | 1/1976 | Hocq | 24/113 MP |

*Primary Examiner*—Victor N. Sakran

*Attorney, Agent, or Firm*—Thomas J. Dodd

[57] ABSTRACT

A guard which encloses clothing buttons during cleaning operations. The guard includes a cup-shaped container with a slot which allows the guard to slide over the button. A cap may be releasably secured to the container to completely enclose the button and protect it from damage.

4 Claims, 2 Drawing Sheets

CLOTHING BUTTON GUARD

SUMMARY OF THE INVENTION

The invention relates to a guard for clothing buttons which protects the buttons from damage during commercial cleaning operations.

A recurrent problem in the commercial cleaning business is the damage often caused to the clothing buttons during cleaning. While most buttons are not affected by detergents or any dry cleaning fluids, constant rapid tumbling often causes the buttons to contact the walls of the cleaning tank where they are easily chipped or broken.

Commercial cleaners currently protect clothing buttons from damage by wrapping them in aluminum foil prior to cleaning. Other cleaners remove the buttons prior to cleaning then replace them afterwards. Both processes are time consuming and create additional expense which is normally borne by the garment owner. Additionally, foil wrapping is not totally effective in prevent button damage, while removal risks loss of the buttons or even a switching with different garments.

The button guard of this invention includes a cup-shaped container which has a longitudinal slot in its side wall. The container sides over the button via the slot to enclose the button and protect it from damage. A cap may then be releasably secured to the container to completely enclose the button in the container.

Accordingly, it is an object of this invention to provide for a guard which protects clothing buttons from damage during cleaning.

Another object is to provide for a button guard which may be rapidly fixed about the button and which is easily and readily detachable after use.

Another object is to provide for an economical guard which completely encloses the button during cleaning.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

Figure 2:
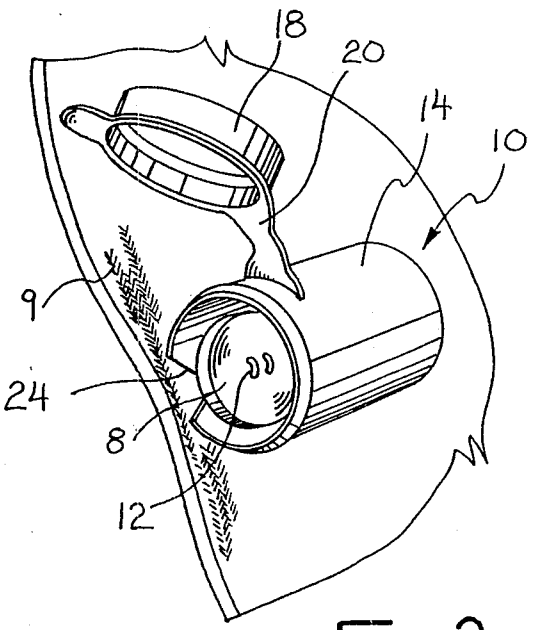
FIG. 2 is a perspective view of the button and guard after connection.

The preferred embodiment herein described is not intended to be exhaustive or to limit the invention to the precise form disclosed. It is chosen and described to explain the principles of the invention and its application and practical use to enable others skilled in the art to utilize the invention.

Referring now to the drawings, reference numeral 10 generally refers to the button guard of this invention which is used to protect a clothing button 8 from damage during cleaning. Button 8 is sewn to garment 9 in a conventional manner and is attached to the garment by thread 12.

Button guard 10 is preferably cup-shaped and is formed of molded plastic or similar material which is resistent to deterioration by detergents and dry cleaning fluids. Guard 10 is generally cup-shaped and includes continuous side wall 14 and bottom wall 16. A cap 18 may be pivotally connected to side wall 14 through an integral hinge 20, commonly referred to as a "living hinge". Side wall 14 has a longitudinal slot 22 which may have a bevelled or rounded upper edge 24 as shown. Cap 18 preferably includes annular projection 26 which allows the cap to be releasably secured to guard 10 in a snap-interlock fashion.

Figure 1:
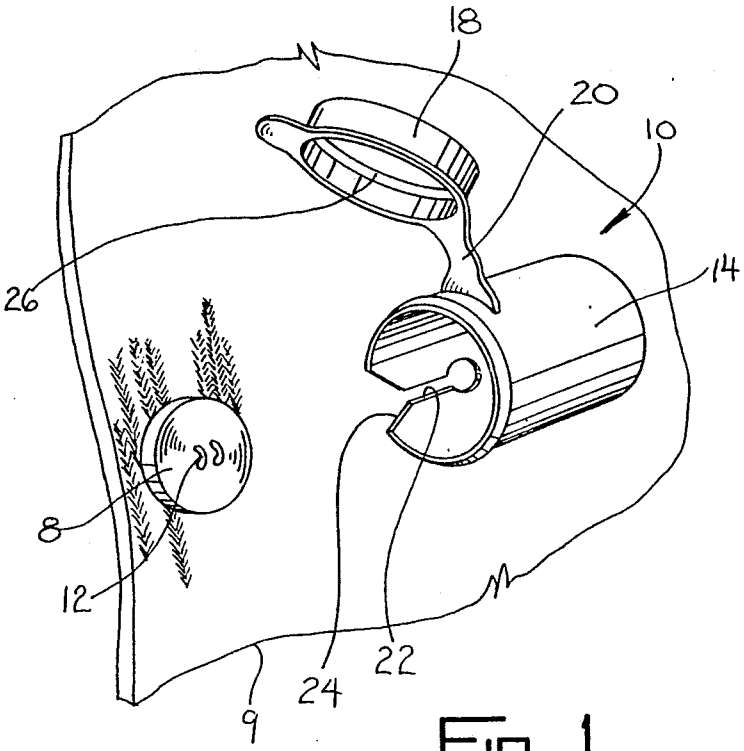
FIG. 1 is a perspective view of a button and the guard prior to connection.
Figure 4:
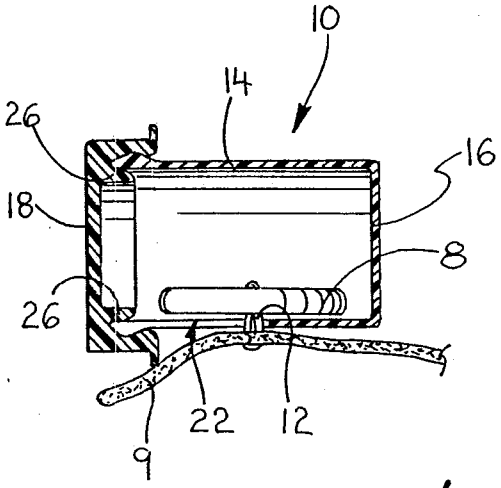
FIG. 4 is a sectional view taken along line 4—4 of FIG. 3.
Figure 3:
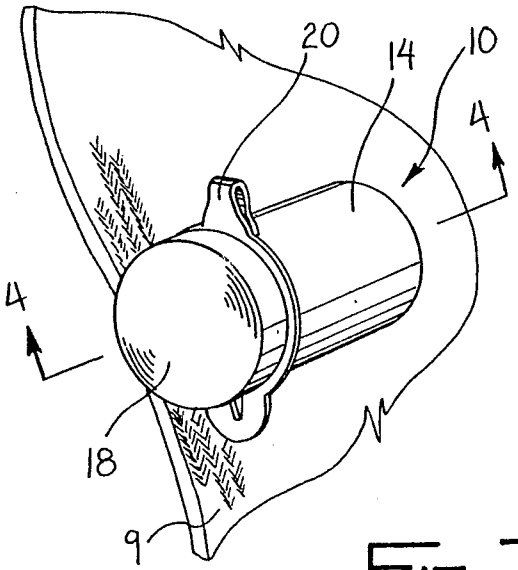
FIG. 3 is a perspective view of the button and guard after securement of the cap.

FIGS. 1–3 illustrate the use of button guard 10. Guard 10 is positioned as shown in FIG. 2 with slot 22 aligned with thread 12 and then slid over button 8 with the thread 12 extending through slot 22 (FIG. 2). With the button contained inside of guard 10, cap 18 is snap-fitted onto the guard to completely enclose the button 8 therein (FIG. 3) and protect the button from damage during cleaning. To remove guard 10 after cleaning, the above process is reversed.

It is understood that the invention is not limited to the details above-given, but may be modified within the scope of the following claims.

I claim:

1. A guard for protecting a clothing button, said guard comprising a container having a side wall and an end wall to define an enclosure means for surrounding a clothing button, said side wall having an elongated longitudinal slot formed therein to allow said clothing button to be slid completely into said enclosure means, and a cap releasably secured to said guard side wall at a top edge thereof wherein said clothing button is virtually surrounded by said guard.

2. The guard of claim 1 wherein said cap is connected to said side all by an integral hinge part.

3. The guard of claim 1, wherein said slot is defined by diverging outer sides to facilitate sliding said guard about said button.

4. A method of safeguarding a clothing button during cleaning, said method comprising the steps of:

providing a guard having a side wall and an end wall to define an enclosure;

forming an elongated longitudinal slot in said guard side wall;

sliding said button completely into said enclosure with a garment connecting thread of said button fitted in said slot; and releasably securing a cap to said guard at a top edge of said side wall to completely enclose the button within the guard.

* * * * *